US007277023B1

(12) United States Patent
Berry

(10) Patent No.: US 7,277,023 B1
(45) Date of Patent: Oct. 2, 2007

(54) OUTDOOR SIGNALING APPARATUS

(76) Inventor: Chopin Berry, 630 Kingsboro 6th Walk 1D, Brooklyn, NY (US) 11233

( * ) Notice: Subject to any disclaimer, the term of this patent is extended or adjusted under 35 U.S.C. 154(b) by 266 days.

(21) Appl. No.: 11/100,930

(22) Filed: Apr. 6, 2005

(51) Int. Cl.
*G08B 5/00* (2006.01)

(52) U.S. Cl. ..... 340/815.4; 40/541; 340/321; 340/693.5; 340/815.65; 362/184

(58) Field of Classification Search ..... 340/815.4, 340/815.45, 815.65, 691.1, 693.5, 321, 332, 340/434, 908; 362/184–186; 116/202; 40/541
See application file for complete search history.

(56) References Cited

U.S. PATENT DOCUMENTS 2,194,818 A 3/1940 Book
2,493,112 A 1/1950 Christopher
3,728,708 A 4/1973 Culbertson
4,847,589 A * 7/1989 Dobbins ..... 340/321
5,694,110 A 12/1997 Clifford
5,905,441 A * 5/1999 Klee et al. ..... 340/815.4
6,000,811 A * 12/1999 Bordak ..... 340/321
6,363,641 B1 * 4/2002 Martinez ..... 40/586

* cited by examiner

*Primary Examiner*—Thomas Mullen

(57) ABSTRACT

An outdoor signaling apparatus that can be used for several various notification purposes. The outdoor signaling apparatus has a circular outer casing and a retractable rod attached to the outer casing. Within the outer casing, there are two separate compartments, each of which has a red light, blue light, and yellow light. An individual, through incorporated power means, can turn on all the lights of a particular color and use the outdoor signaling apparatus for various purposes, depending on the color of the lights being displayed.

7 Claims, 3 Drawing Sheets

OUTDOOR SIGNALING APPARATUS

I. BACKGROUND OF THE INVENTION

The present invention relates to an outdoor signaling apparatus that can be used for several various notification purposes.

II. DESCRIPTION OF THE PRIOR ART

U.S. Pat. No. 5,694,110, issued to Clifford, discloses a hand-held, illuminated signal device for alerting passing persons of situations such as an emergency.

U.S. Pat. No. 3,728,708, issued to Culbertson, discloses an illuminated marker light having various numbers lights.

U.S. Pat. No. 2,493,112, issued to Christopher, discloses a signal device comprised of a circular housing supported by a bracket arm, with lenses allowing lights to shine through for signaling.

U.S. Pat. No. 2,194,818, issued to Book, discloses a portable signaling device capable of illuminating various signs to warn of danger or call for help.

III. SUMMARY OF THE INVENTION

The present invention relates to an outdoor signaling apparatus that can be used for several various notification purposes. The outdoor signaling apparatus has a circular outer casing and a retractable rod attached to the outer casing. Within the outer casing, there are two separate compartments, each of which has a red light, blue light, and yellow light. An individual, through incorporated power means, can turn on all the lights of a particular color and use the outdoor signaling apparatus for various purposes, depending on the color of the lights being displayed.

There has thus been outlined, rather broadly, the more important features of a outdoor signaling apparatus in order that the detailed description thereof that follows may be better understood, and in order that the present contribution to the art may be better appreciated. There are additional features of the outdoor signaling apparatus that will be described hereinafter and which will form the subject matter of the claims appended hereto.

In this respect, before explaining at least one embodiment of the outdoor signaling apparatus in detail, it is to be understood that the outdoor signaling apparatus is not limited in its application to the details of construction and to the arrangements of the components set forth in the following description or illustrated in the drawings. The outdoor signaling apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present outdoor signaling apparatus. It is important, therefore, that the claims be regarded as including such equivalent constructions insofar as they do not depart from the spirit and scope of the present invention.

It is another object of the present invention to provide an outdoor signaling apparatus which has all of the advantages of the prior art and none of the disadvantages.

It is another object of the present invention to provide an outdoor signaling apparatus which may be easily and efficiently manufactured and marketed.

It is another object of the present invention to provide an outdoor signaling apparatus which is of durable and reliable construction.

It is yet another object of the present invention to provide an outdoor signaling apparatus which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
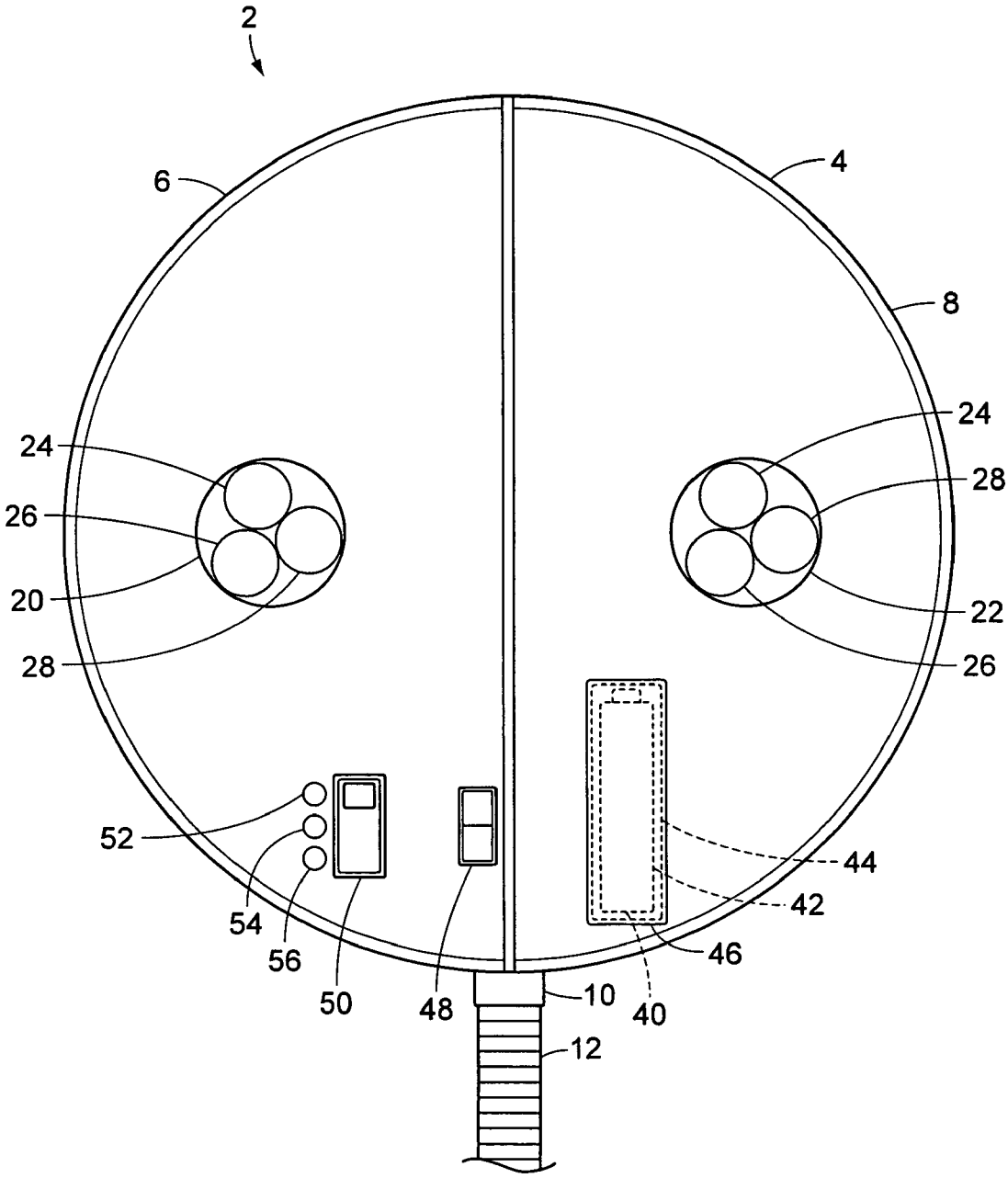
FIG. 1 shows a front view of the present invention.
Figure 3:
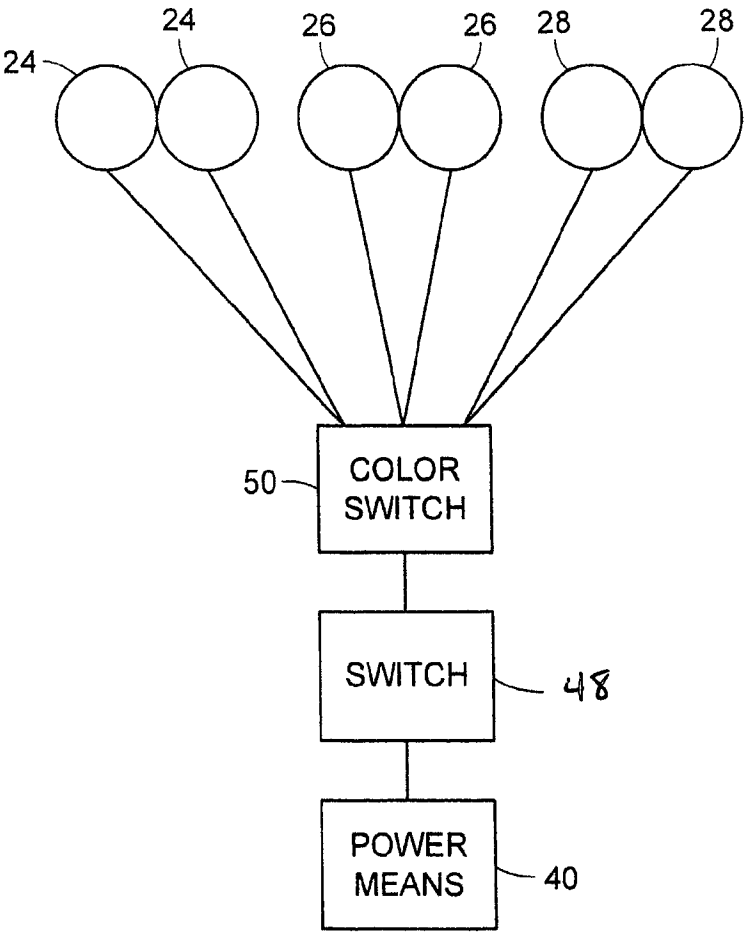
FIG. 3 shows an electronic schematic of the present invention.
Figure 2:
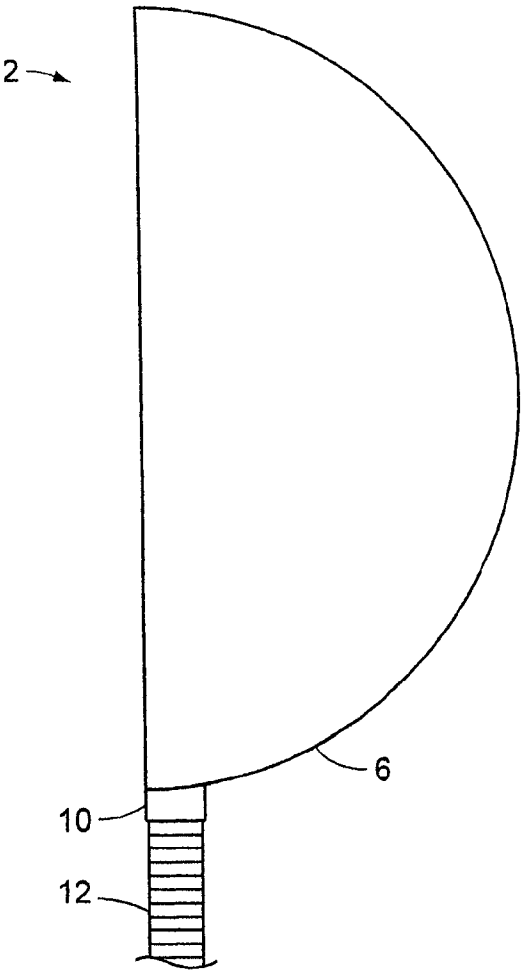
FIG. 2 shows the present invention as it would appear folded in half.

FIG. 1 shows a front view of the present invention, while FIG. 2 shows the present invention as it would appear folded in half. Furthermore, FIG. 3 shows an electronic schematic of the present invention. The present invention comprises an outdoor signaling apparatus 2 that can be designed to display one of several different colors, with each color representing a specific message by being displayed.

Outdoor signaling apparatus 2 comprises a circular casing 4 that comprises two halves, a left half 6 and a right half 8. Each of the halves are hollow and has two surfaces, a front surface and a rear surface, and the two halves are pivotally attached to one another on their front surfaces. For storage purposes or when the outdoor signaling apparatus 2 is not in use, the two halves can folded against one another, as seen in FIG. 2. The circular casing 4 is fabricated from a highly reflective material.

Attached to the circular casing 4 is also located a base 10. Retractable rod 12 has two ends, a first end and a second end, with the first end of the retractable rod 12 being attached to the base 10. The retractable rod 12 can be retracted to the point where it is only a few inches long, and conversely, can be extended so that it is up to twenty-four inches long when fully extended.

Within the left half 6 of the circular casing 4 is a left central compartment 20, while within the right half 8 of the circular casing 4 is a right central compartment 22. Each of the compartments are centrally located within their respective halves of the circular casing 4, and each compartment has a yellow light 24, a blue light 26, and a red light 28. Through the electronics of the outdoor signaling apparatus 2, lights of only one color would be lit at any particular time.

Power means 40 is located within one of the halves of the circular casing 4, with the power means 40 preferably being at least one battery 42. The battery 42 is located within a battery compartment 44 that is accessible through a battery door 46. Furthermore, an on/off switch 48 is located on the surface of one of the halves of the circular casing 4, with the on/off switch 48 being a two-position switch, having an "on" position and an "off" position.

Next to the on/off switch 48 is located a color switch 50, with the color switch 50 having three separate positions, corresponding to the light colors, which are yellow, red, and blue.

As can be seen from FIG. 3, the power means 40 is connected to the on/off switch 48, which acts as a circuit breaker. When the on/off switch 48 is in the "off" position, the electrical connection between the power means 40 and the color switch 50 is open. However, when the on/off switch 48 is in the "on" position, the electrical connection between the power means 40 and the color switch 50 is closed.

Once power reaches the color switch 50, an individual can place this color switch 50 into one of three possible positions, corresponding to the light colors, which are yellow, red, and blue. If the individual chooses to place this color switch 50 into the blue position 52, then the electrical connection between the power means 40 and the two blue lights 26 in the compartments 20 and 22 are complete. If the individual chooses to place this color switch 50 into the red position 54, then the electrical connection between the power means 40 and the two red lights 28 in the compartments 20 and 22 are complete. Finally, if the individual chooses to place this color switch 50 into the yellow position 56, then the electrical connection between the power means 40 and the two yellow lights 24 in the compartments 20 and 22 are complete.

Figure 4:
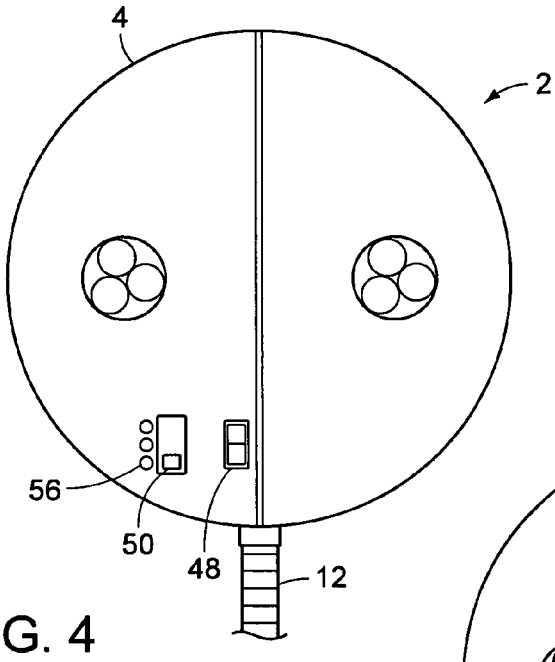
FIG. 4 shows the invention as it would appear displaying a yellow color.

FIG. 4 shows the outdoor signaling apparatus 2 as it would appear displaying a yellow color. In this configuration, the on/off switch 48 is in the "on" position and the color switch 50 is in the yellow position 56. Ideally, the fact that the outdoor signaling apparatus 2 is yellow signifies that a taxicab is available and would be used for that purpose.

Figure 5:
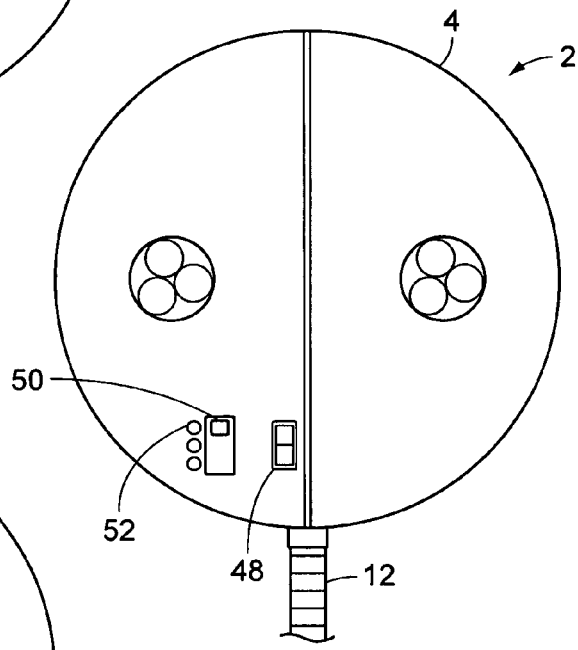
FIG. 5 shows the invention as it would appear displaying a blue color.

FIG. 5 shows the outdoor signaling apparatus 2 as it would appear displaying a blue color. In this configuration, the on/off switch 48 is in the "on" position and the color switch 50 is in the blue position 52. Ideally, the fact that the outdoor signaling apparatus 2 is blue signifies either that police are present and/or available, whether it be in regular course or in the course of an emergency.

Figure 6:
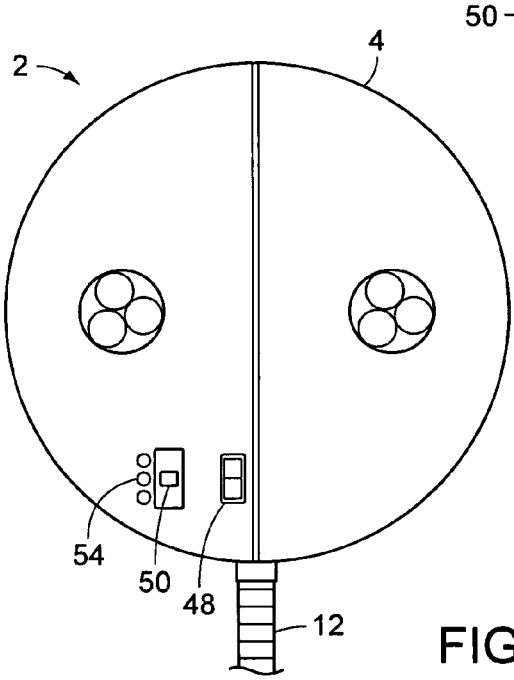
FIG. 6 shows the invention as it would appear displaying a red color.

FIG. 6 shows the outdoor signaling apparatus 2 as it would appear displaying a red color. In this configuration, the on/off switch 48 is in the "on" position and the color switch 50 is in the red position 54. Ideally, the fact that the outdoor signaling apparatus 2 is yellow signifies either that a fire department vehicle is present and/or available, whether it be in regular course or in the course of an emergency.

What I claim as my invention is:

1. An outdoor signaling apparatus comprising:

a circular casing comprising two halves, a left half and a right half, each of the halves having two surfaces, a front surface and a rear surface, the two halves being pivotally attached to one another on their front surfaces, a base attached to the circular casing, a retractable rod having two ends, a first end and a second end, the first end of the retractable rod being attached to the base, a pair of compartments comprising a left central compartment and a right central compartment, the left central compartment being centrally located within the left half of the circular casing, the right central compartment being centrally located within the right half of the circular casing, a plurality of lights located within each compartment, each light within a particular compartment having a different color, the number of lights located within each compartment being the same as the other compartment, wherein each light of a particular color within one compartment has a matching light of the same color within the other compartment, power means located within the circular casing, the power means used to provide power to one or more lights of the plurality of lights located within the pair of compartments, a compartment to house the power means, the compartment being located within the circular casing, an on/off switch having two positions, an "on" position and an "off" position, the on/off switch connected to the power means, the on/off switch designed to act as a circuit in between the power means and one or more lights of the plurality of lights located within the pair of compartments, means for turning on lights of a particular color within the pair of compartments.

2. An outdoor signaling apparatus according to claim 1 wherein the circular casing is fabricated from a reflective material.

3. An outdoor signaling apparatus according to claim 2 wherein the retractable rod can be extended to a length of up to two feet.

4. An outdoor signaling apparatus according to claim 3 wherein the power means is at least one battery.

5. An outdoor signaling apparatus according to claim 4 wherein the plurality of lights located within each compartment of the pair of compartments equals three lights.

6. An outdoor signaling apparatus according to claim 5 wherein the colors of the lights located within each compartment of the pair are red, yellow, and blue.

7. An outdoor signaling apparatus according to claim 6 wherein the means for turning on lights of a particular color within the pair of compartments comprises a color switch, the color switch being located on the circular casing, the color switch serving as a three-position switch and being electronically placed in between the on/off switch and the plurality of lights, the three positions of the color switch being a red position, a yellow position, and a blue position, wherein placing the color switch to the red position will illuminate each red light within each compartment of the pair of compartments providing the on/off switch is in the "on" position, further wherein placing the color switch to the yellow position will illuminate each yellow light within each compartment of the pair of compartments providing the on/off switch is in the "on" position, and further wherein placing the color switch to the blue position will illuminate each blue light within each compartment of the pair of compartments providing the on/off switch is in the "on" position.

* * * * *